US011096480B2

(12) United States Patent
Moore-Davis

(10) Patent No.: US 11,096,480 B2
(45) Date of Patent: Aug. 24, 2021

(54) COLLAPSIBLE TRAY TABLE

(71) Applicant: Khwanda Gail Moore-Davis, Atlanta, GA (US)

(72) Inventor: Khwanda Gail Moore-Davis, Atlanta, GA (US)

( * ) Notice: Subject to any disclaimer, the term of this patent is extended or adjusted under 35 U.S.C. 154(b) by 0 days.

(21) Appl. No.: 16/697,527

(22) Filed: Nov. 27, 2019

(65) Prior Publication Data

US 2020/0163450 A1 May 28, 2020

Related U.S. Application Data

(60) Provisional application No. 62/772,158, filed on Nov. 28, 2018.

(51) Int. Cl.

| | |
|---|---|
| ***A47B 3/06*** | (2006.01) |
| ***A47B 9/18*** | (2006.01) |
| ***A47B 3/10*** | (2006.01) |

(52) U.S. Cl.

CPC ..... *A47B 3/06* (2013.01); *A47B 3/10* (2013.01); *A47B 9/18* (2013.01)

(58) Field of Classification Search

CPC ..... A47B 3/06; A47B 3/10; A47B 13/003; A47B 13/02; A47B 13/08; A47B 13/023

USPC ..... 108/19, 150, 153.1, 157.1, 159

See application file for complete search history.

(56) References Cited

U.S. PATENT DOCUMENTS

| | | | | | |
|---|---|---|---|---|---|
| 1,265,516 | A | * | 5/1918 | Reck | A47B 3/00 108/166 |
| 3,283,733 | A | * | 11/1966 | Boerma | A45F 3/44 108/159 |
| 3,467,033 | A | * | 9/1969 | Remer | A47C 9/10 108/150 |
| 3,669,392 | A | | 6/1972 | Saunders | |
| 3,703,872 | A | | 11/1972 | Barrevecchia | |
| 3,895,771 | A | * | 7/1975 | Baum | A47B 13/023 248/188.7 |
| 5,121,697 | A | * | 6/1992 | Baum | A47B 3/0803 108/124 |
| 5,540,159 | A | * | 7/1996 | Anderson | A47B 13/02 108/150 |

(Continued)

FOREIGN PATENT DOCUMENTS

| | | | |
|---|---|---|---|
| DE | 10039054 | * | 6/2002 |
| WO | 2007071190 | * | 6/2007 |

*Primary Examiner* — Janet M Wilkens

(74) *Attorney, Agent, or Firm* — Dunlap Bennett & Ludwig, PLLC

(57) ABSTRACT

A collapsible tray table is provided. The collapsible tray table is adapted for use in confined seating situations. The collapsible tray table is movable between a collapsed condition and at least one operable condition. The collapsible tray table may have one or more tray legs and one or more second leg portions that depend from a tray top. The tray legs and second leg portions are interchangeable for providing different operable conditions and thus elevations of the tray table relative from its footing. The tray legs and second leg portions are adapted to removably connect to the underside of the tray table in a collapsed condition, thereby minimizing the low profile of the assembly in crowded seating arrangements. The collapsible tray table may provide handles and a carrying strap for facilitating transportation and manipulation of the tray table while in use.

10 Claims, 4 Drawing Sheets

(56) References Cited

U.S. PATENT DOCUMENTS

| | | | | |
|---|---|---|---|---|
| 5,913,269 | A | 6/1999 | Franssen et al. | |
| 6,467,843 | B1 * | 10/2002 | Rossborough | A47C 3/34 108/150 |
| 6,505,565 | B1 | 1/2003 | Byung et al. | |
| 6,889,618 | B1 | 5/2005 | Gromack | |
| 8,573,138 | B2 | 11/2013 | Unger | |
| D730,087 | S * | 5/2015 | Strater | D6/656.13 |
| 9,167,892 | B1 | 10/2015 | Korb | |
| 9,301,621 | B2 * | 4/2016 | Barstad | A47C 4/022 |
| 9,622,571 | B1 | 4/2017 | Wassel et al. | |
| 9,848,695 | B1 | 12/2017 | Gauss | |
| 2004/0139892 | A1 | 7/2004 | Giegerich | |
| 2005/0199162 | A1 | 9/2005 | Hendricks et al. | |
| 2007/0277711 | A1 | 12/2007 | Grant | |
| 2008/0022904 | A1 | 1/2008 | Matheus et al. | |
| 2008/0163798 | A1 | 7/2008 | Shearer-Robinson | |
| 2008/0224505 | A1 | 9/2008 | Gerard | |
| 2009/0241811 | A1 | 10/2009 | Markegard et al. | |
| 2011/0000405 | A1 | 1/2011 | Clark et al. | |
| 2011/0048288 | A1 | 3/2011 | Sheldon | |
| 2012/0279429 | A1 | 11/2012 | Goldszer | |
| 2012/0285351 | A1 | 11/2012 | Cohen | |
| 2013/0333595 | A1 * | 12/2013 | Cotey | A47B 13/023 108/42 |
| 2014/0102337 | A1 | 4/2014 | Ralph et al. | |
| 2015/0068433 | A1 * | 3/2015 | Nardi | A47B 13/16 108/25 |
| 2016/0174706 | A1 | 6/2016 | Volin | |
| 2016/0242537 | A1 * | 8/2016 | Hernandez | A47B 9/08 |
| 2017/0318958 | A1 * | 11/2017 | Asante | A47B 19/06 |
| 2018/0213926 | A1 | 8/2018 | Brensinger | |

* cited by examiner

COLLAPSIBLE TRAY TABLE

CROSS-REFERENCE TO RELATED APPLICATION

This application claims the benefit of priority of U.S. provisional application No. 62/772,158, filed 28 Nov. 2018, the contents of which are herein incorporated by reference.

BACKGROUND OF THE INVENTION

The present invention relates to trays and, more particularly, a collapsible tray table adapted for use in confined seating situations, such as when at a concert, sporting event, camping or the like.

When seated, for example, while attending a concert or sports event, it can be a challenge to use one's lap to hold food, drinks and other lap-sized items without infringing on the space of others adjacent to you. There currently is no tray specially adapted for stadium/arena/bleacher use; specifically, a tray that is vertically adjustable so as to move between a plurality of operable conditions and a collapsed condition, wherein each condition is associated with a different elevation relative to a base/footing of the collapsible tray.

As can be seen, there is a need for collapsible tray-table adapted for use in confined seating situations, such as when at a concert, sporting event, camping or the like. The collapsible tray table is adapted so a user can place and support lap-sized items thereon, instead of using one's lap. The collapsible tray table is designed to fit immediately in front of the user in the seated position, above their lap. The collapsible tray table is a small and sturdy tray table just right for one or two people.

There are no other tray tables specifically designed for making one's stadium/arena/bleacher eating experience more comfortable than eating from one's lap.

SUMMARY OF THE INVENTION

In one aspect of the present invention, a collapsible tray table including the following: a substrate defined in part by a first surface and a second surface; an underside connector attached to the first surface; two attachment devices located on the first surface; a tray leg having a tray leg periphery extending between two opposing tray leg ends, the tray leg periphery dimensioned to removably engage either of the two attachment devices in a parallel orientation relative to the first surface, and both of the two opposing tray leg ends dimensioned to removably engage the underside connector, respectively, in an orthogonal orientation relative to the first surface in one of a plurality of operable conditions; a second leg having a second leg periphery extending between two opposing second leg ends, the second leg periphery dimensioned to removably engage either of the two attachment devices in a parallel orientation relative to the first surface, and either of the two opposing second leg ends dimensioned to removably engage the underside connector, respectively, in an orthogonal orientation relative to the first surface in another of the plurality of operable conditions; a footing dimensioned to removably engage either of the opposing tray leg ends, either of the opposing second leg ends, or the underside connector in a collapsed condition; and a coupler removably locking one of the two opposing second leg ends to one of the two opposing tray leg ends in yet another of the plurality of operable conditions; a cup cavity provided along the second surface; a handle and or a carrying strap connected to the substrate, wherein the tray leg and the second leg are cylindrical, wherein certain embodiments a tray leg distance between the two opposing tray leg ends is ten to twenty percent longer than a second leg distance defined by the two opposing second leg ends, wherein each of the plurality of operable conditions spaces the second surface an elevational distance apart from the footing that is distinguishable from the other of the plurality of operable conditions.

In another aspect of the present invention, the collapsible tray table, includes the following: a substrate defined in part by a first surface and a second surface; two underside connectors attached to the first surface; four attachment devices located on the first surface; two tray legs; each tray leg having a tray leg periphery extending between two opposing tray leg ends, the tray leg periphery dimensioned to removably engage either of the four attachment devices in a parallel orientation relative to the first surface, and both of the two opposing tray leg ends dimensioned to removably engage either of the two underside connectors, respectively, in an orthogonal orientation relative to the first surface in one of a plurality of operable conditions; two second legs; each second leg having a second leg periphery extending between two opposing second leg ends, the second leg periphery dimensioned to removably engage either of the four attachment devices in a parallel orientation relative to the first surface, and either of the two opposing second leg ends dimensioned to removably engage either of the two underside connectors, respectively, in an orthogonal orientation relative to the first surface in another of the plurality of operable conditions; two footings; each footing dimensioned to removably engage either of the opposing tray leg ends, either of the opposing second leg ends, or either of the underside connectors in a collapsed condition; two couplers; and each coupler removably locking one of the two opposing second leg ends to one of the two opposing tray leg ends in yet another of the plurality of operable conditions; a cup cavity provided along the second surface; a handle and or a carrying strap connected to the substrate, wherein the tray leg and the second leg are cylindrical, wherein certain embodiments, a tray leg distance between the two opposing tray leg ends is ten to twenty percent longer than a second leg distance defined by the two opposing second leg ends, wherein each of the plurality of operable conditions spaces the second surface an elevational distance apart from the footing that is distinguishable from the other of the plurality of operable conditions.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a collapsible tray-table adapted for use in confined seating situations, such as when at a concert, sporting event, camping or the like. The collapsible tray table is movable between a collapsed condition and at least one operable condition. The collapsible tray table may have one or more tray legs that depend from a tray top, wherein the tray legs are adapted to removably connect to the underside of the tray table in a collapsed condition. The collapsible tray table may provide handles and a carrying strap for facilitating transportation and manipulation of the tray table.

Figure 1:
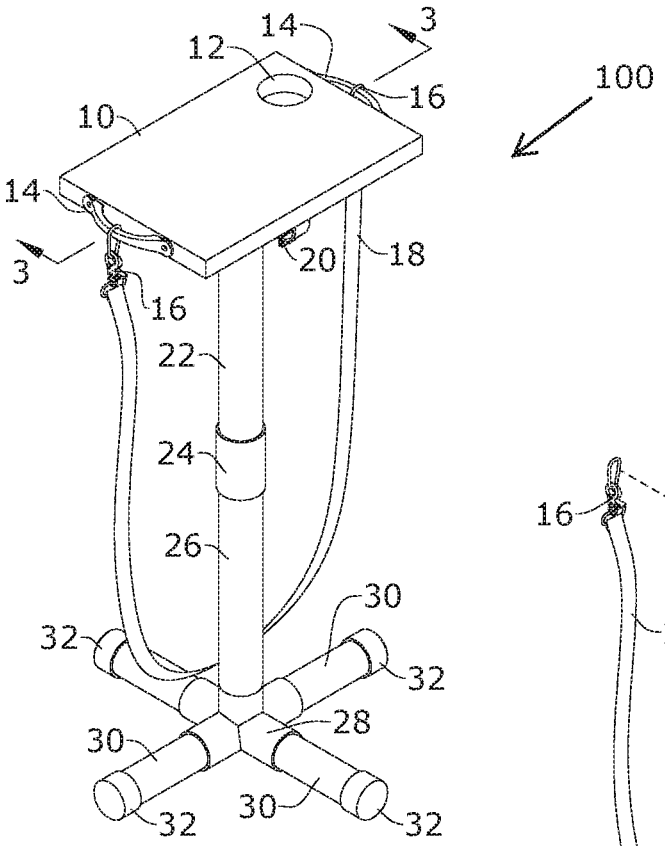
FIG. 1 is a perspective view of an exemplary embodiment of the present invention, shown in use in an operable condition.
Figure 2:
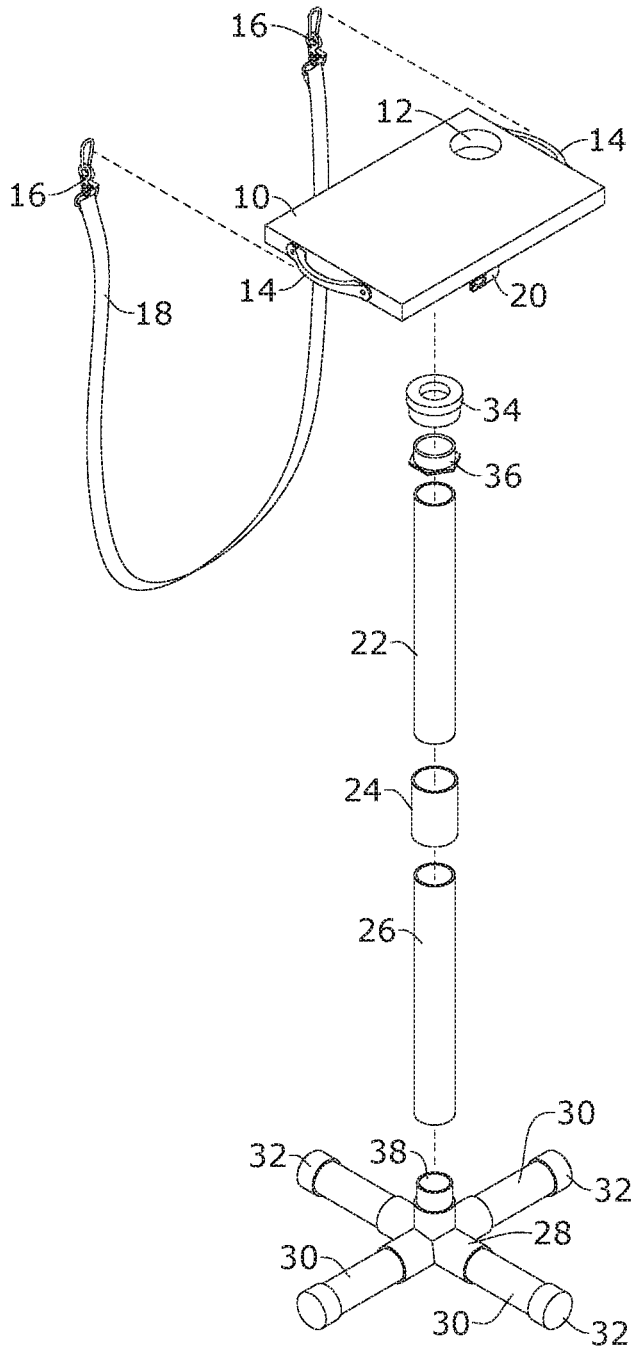
FIG. 2 is an exploded view of an exemplary embodiment of the present invention.
Figure 3:
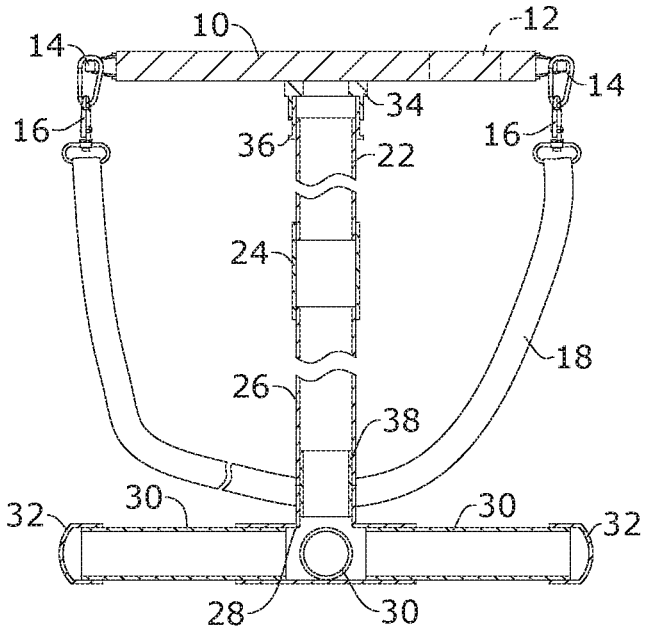
FIG. 3 is a section view of an exemplary embodiment of the present invention, taken along line 3-3 in FIG. 1.
Figure 4:
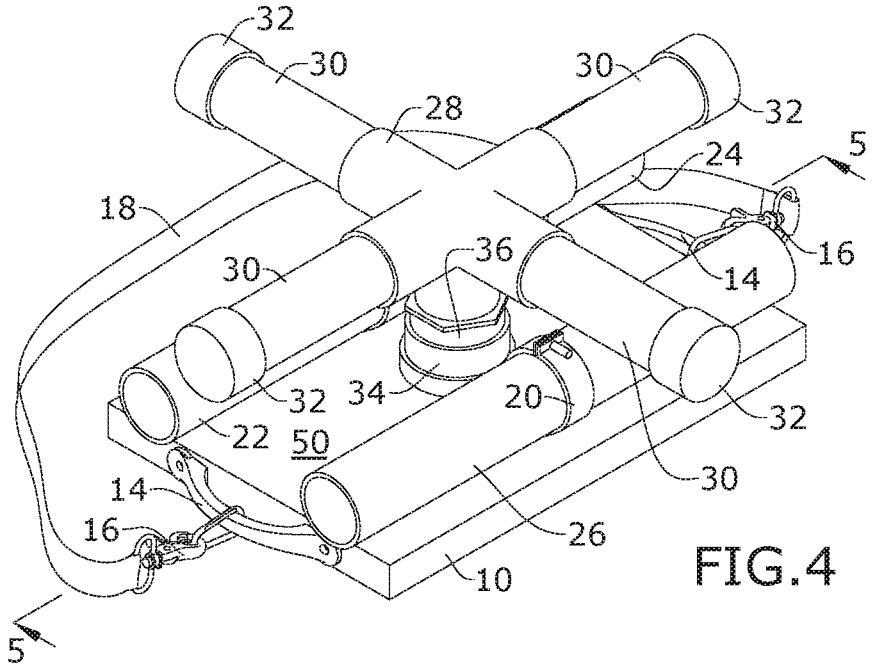
FIG. 4 is a perspective view of an exemplary embodiment of the present invention, rotated so as to view an underside, illustrating a collapsed condition.
Figure 5:
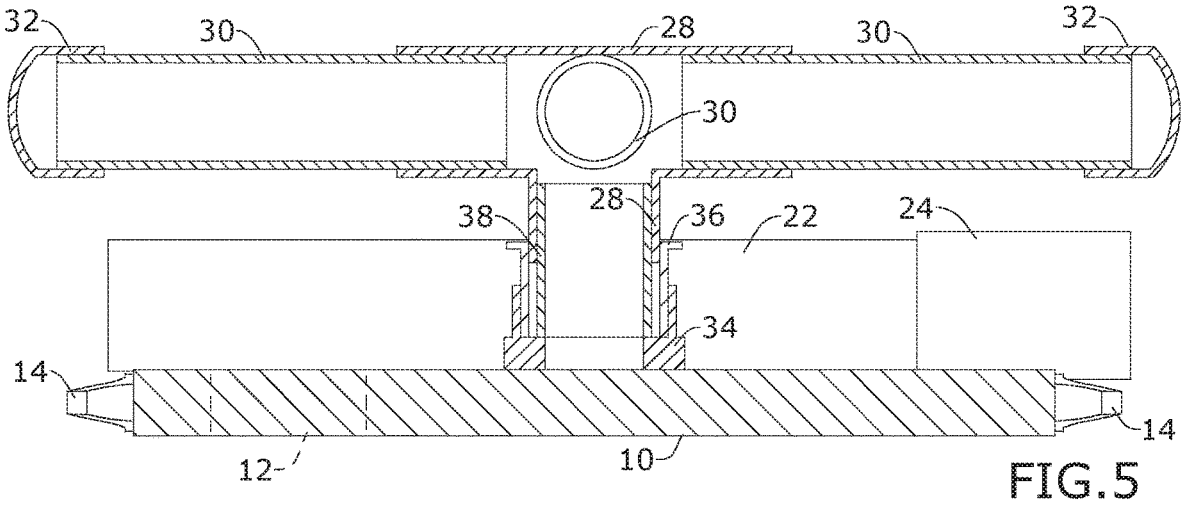
FIG. 5 is a section view of an exemplary embodiment of the present invention, taken along line 5-5 in FIG. 4.
Figure 6:
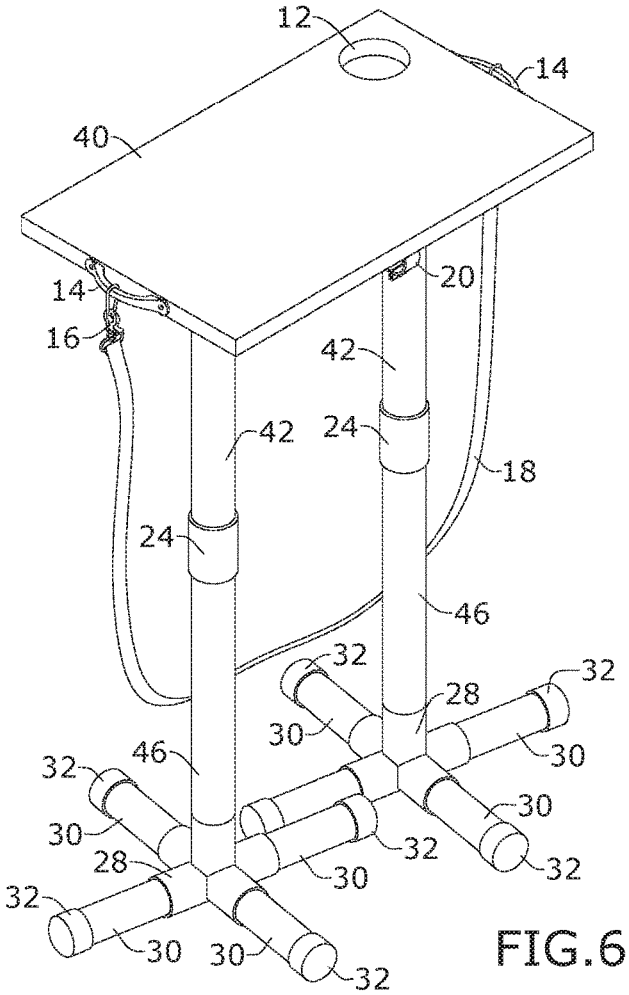
FIG. 6 is a perspective view of another exemplary embodiment of the present invention, illustrating an operable condition.
Figure 7:
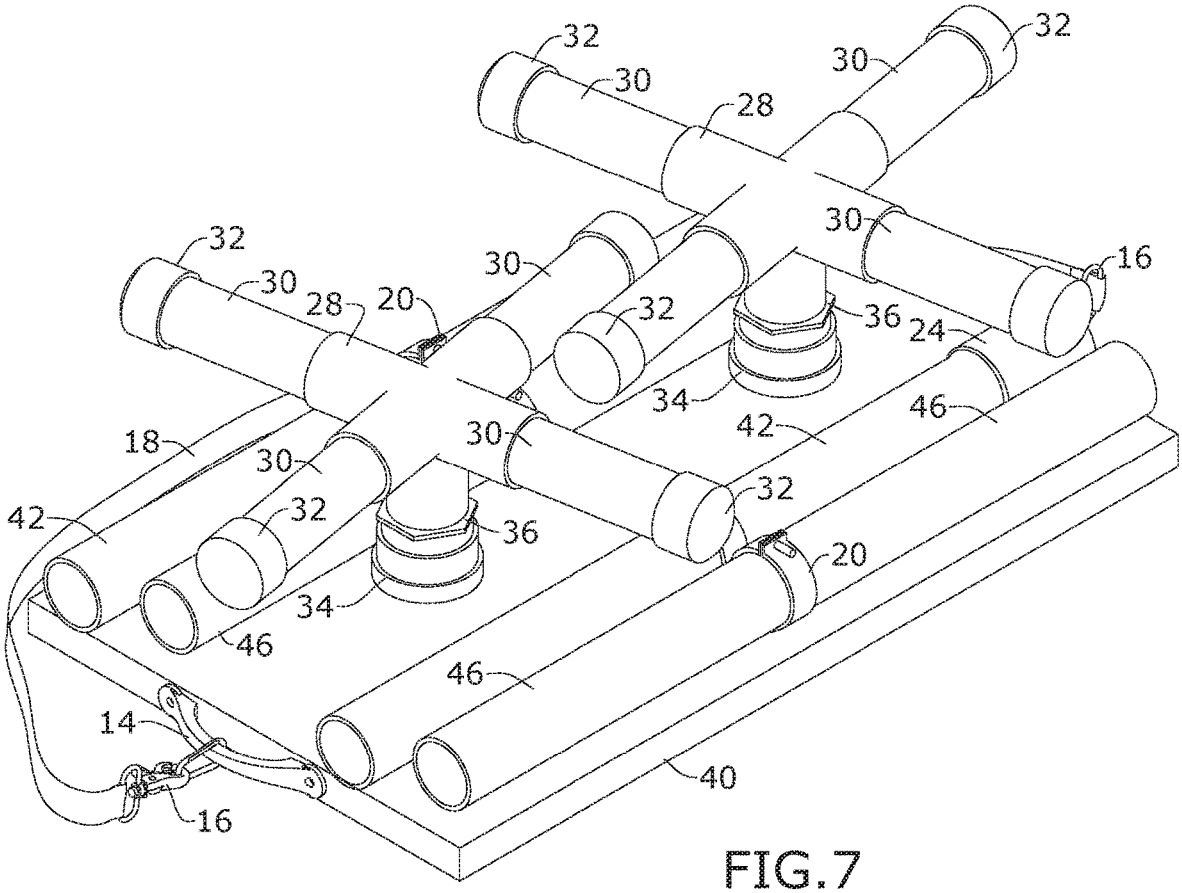
FIG. 7 is a perspective view of another exemplary embodiment of the present invention, illustrating the collapsed condition from the underside.

Referring now to FIG. 1 through 7, the present invention may include a collapsible tray table 10 movable between at least one operable condition (FIG. 1) and a collapsed condition (FIG. 4). The collapsible tray table 100 may include tray top 10/40 and one or more removable tray legs 22/42 depending there from. The tray top 10/40 may be a generally planar substrate made from wood, plastic or other materials that are sufficiently sturdy and resistant to bending under the loading contemplated herein. The tray top 10/40 may provide a cup holder opening 12 provided therein.

The tray legs 22/42 may be PVC pipes or the like. Each tray leg 22/42 may be extended in length through the addition of a second leg portion 26/46, respectively. The second leg portion 26/46 may be coupled to the tray leg 22/42 by way of a coupler 24. In certain embodiments, the second leg portion 26/46 may be telescopically associated with the tray leg 22/42 so that a plurality of operable conditions is selectively possible. In such embodiments, the coupler 24 may be adapted to form a locking engagement between the second leg portion 26/46 and telescopically associated tray leg 22/42 at different operable conditions/elevations.

Underside connectors 34, 36 and 38, such as a socket, a spigot and an inner coupling, respectively, may removably connect the tray legs 22/42 to an underside 50 of the tray top 10/40 in the collapsed condition. Each tray leg 22/42 may extend from foot to waist height in the operable condition.

One or more attachment devices 20 may be adapted to store the tray legs 22/42 and 26/46 to said underside 50. The attachment devices 20 may be collar providing an opening to slidably receive and secure the second leg portion 26/46 to the underside 50 in a parallel relationship thereto; thereby, enabling a low provide in the collapsed condition. The collapsible tray table 100 may provide one or more handles 14 to manipulate, control, place, move and transport the collapsible tray table 100. A carrying strap 18 may be connected to the collapsible tray table 100 for carrying it about. In certain embodiments, strap clips 16 may connect the carrying strap 18 to the handles 14.

Each tray leg 22/42 may have a leg footing 30. The leg footing 30 may also be PVC pipe for providing stability to the tray legs 22/42 and 26/46 and by extension the collapsible tray table 100. The tray legs 22/42 and 26/46 and leg footings 30, therefore, may be interchangeable because their respective sizes are identical for each of these components. The leg footings 30 may connected to the tray legs 22/42, second leg portion 26/46, or the underside connectors 34, 36 and 38, by the way of elbow connectors 28. The leg footings 30 would connect to the underside connectors 34, 36 and 38 in the collapsed condition, for maintaining a low profile, for ease of storage and transportation. Each leg footing 30 may terminate in toe caps 32.

Once a user assembles the collapsible tray table 100, it stands on its own in the operable condition and is stable enough to place a lap-sized meal and drink on it. Because of its size it takes up very little space in the operable condition, as well as in the collapsed condition.

A method of using the present invention may include the following. The collapsible tray table 100 disclosed above may be provided. A user could put the collapsible tray table 100 together and use it to place their lap-sized meal on instead of using their lap. Additionally, the collapsible tray table 100 can be used in any situation where you need a small personal table that does not take up a lot of space. For example, it could be used as a laptop (computer) table, a camping table, a small card playing table, a small bedside table or a small table for vendors to use to display smaller items.

The second leg portions 26/46 and the tray leg 22/42 may have different operable lengths, so that a user has the option of only interconnecting the tray top 10/40 to only the second leg portion(s) 26/46 before connecting the footing 30. Likewise, the user could only connect the tray leg 22/42 before connecting the footing 30 to have a different elevation (relative to the footing 30) of the tabletop of the tray top 10/40, compared to assembling only the second leg portion(s) 26/46. This provides the user a selection of operable conditions/elevations to choose from.

It should be understood by those skilled in the art that the use of directional terms such as upper, lower, upward, downwardly, top, left, right and the like are used in relation to the illustrative embodiments as they are depicted in the figures, the upward direction (or upper) being toward the top of the corresponding figures, the downward (lower, underside) direction being toward the bottom of the corresponding figures.

It should be understood, of course, that the foregoing relates to exemplary embodiments of the invention and that modifications may be made without departing from the spirit and scope of the invention as set forth in the following claims.

What is claimed is:

1. A collapsible tray table, comprising:

a substrate defined in part by a first surface and a second surface;

an underside connector attached to the first surface;

two attachment devices located on the first surface;

a tray leg having a tray leg periphery extending between two opposing tray leg ends, the tray leg periphery dimensioned to removably engage either of the two attachment devices in a parallel orientation relative to the first surface, and both of the two opposing tray leg ends dimensioned to removably engage the underside connector, respectively, in an orthogonal orientation relative to the first surface in one of a plurality of operable conditions;

a second leg having a second leg periphery extending between two opposing second leg ends, the second leg periphery dimensioned to removably engage either of the two attachment devices in a parallel orientation relative to the first surface, and either of the two opposing second leg ends dimensioned to removably engage the underside connector, respectively, in an orthogonal orientation relative to the first surface in another of the plurality of operable conditions; and a footing comprising an elbow connector removably connected to a plurality of leg footings, the elbow connector also being removably engaged to either the one of the legs or the underside connector.

2. The collapsible tray table of claim 1, further comprising:

a cup cavity provided along the second surface.

3. The collapsible tray table of claim 1, further comprising:

a handle and or a carrying strap connected to the substrate.

4. The collapsible tray table of claim 1, wherein the tray leg and the second leg are cylindrical.

5. The collapsible tray table of claim 1, wherein a tray leg distance between the two opposing tray leg ends is ten to twenty percent longer than a second leg distance defined by the two opposing second leg ends, wherein each of the plurality of operable conditions spaces the second surface an elevational distance apart from the footing that is distinguishable from the other of the plurality of operable conditions.

6. A collapsible tray table, comprising:

a substrate defined in part by a first surface and a second surface;

two underside connectors attached to the first surface;

four attachment devices located on the first surface;

two tray legs;

each tray leg having a tray leg periphery extending between two opposing tray leg ends, the tray leg periphery dimensioned to removably engage either of the four attachment devices in a parallel orientation relative to the first surface, and both of the two opposing tray leg ends dimensioned to removably engage either of the two underside connectors, respectively, in an orthogonal orientation relative to the first surface in one of a plurality of operable conditions;

two second legs;

each second leg having a second leg periphery extending between two opposing second leg ends, the second leg periphery dimensioned to removably engage either of the four attachment devices in a parallel orientation relative to the first surface, and either of the two opposing second leg ends dimensioned to removably engage either of the two underside connectors, respectively, in an orthogonal orientation relative to the first surface in another of the plurality of operable conditions;

two footings;

each footing comprising an elbow connector removably connected to a plurality of leg footings, the elbow connector also being removably engaged to either the one of the legs or one of the underside connectors;

two couplers; and each coupler removably locking one of the two opposing second leg ends to one of the two opposing tray leg ends in yet another of the plurality of operable conditions.

7. The collapsible tray table of claim 6, further comprising:

a cup cavity provided along the second surface.

8. The collapsible tray table of claim 6, further comprising:

a handle and or a carrying strap connected to the substrate.

9. The collapsible tray table of claim 6, wherein the tray leg and the second leg are cylindrical.

10. The collapsible tray table of claim 6, wherein a tray leg distance between the two opposing tray leg ends is ten to twenty percent longer than a second leg distance defined by the two opposing second leg ends, wherein each of the plurality of operable conditions spaces the second surface an elevational distance apart from the footing that is distinguishable from the other of the plurality of operable conditions.

* * * * *